US006308688B1

(12) United States Patent
French et al.

(10) Patent No.: US 6,308,688 B1
(45) **Date of Patent: *Oct. 30, 2001**

(54) START-ASSIST CIRCUIT

(75) Inventors: Michael J. French; Mark Skrzypchak, both of Pleasant Prairie, WI (US)

(73) Assignee: Bombardier Motor Corporation of America, Grant, FL (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/390,514

(22) Filed: Sep. 3, 1999

Related U.S. Application Data

(63) Continuation of application No. 09/170,853, filed on Oct. 13, 1998, now Pat. No. 5,975,058.

(51) Int. Cl.[7] ..... F02M 51/00
(52) U.S. Cl. ..... 123/490; 123/179.16
(58) Field of Search ..... 123/490, 491, 123/179.16, 179.17, 179.28, 185.3

(56) References Cited

U.S. PATENT DOCUMENTS

| | | | | |
|---|---|---|---|---|
| 4,753,207 | * | 6/1988 | Wright | 123/490 |
| 4,774,624 | * | 9/1988 | Qualich | 123/490 |
| 5,150,687 | * | 9/1992 | Paganon et al. | 123/490 |
| 5,975,058 | * | 11/1999 | French et al. | 123/490 |

* cited by examiner

*Primary Examiner*—John Kwon
(74) *Attorney, Agent, or Firm*—Fletcher, Yoder & Van Someren

(57) ABSTRACT

A start-assist circuit for increasing the fuel-injection voltage during the startup of an internal combustion engine having fuel injectors, a starter solenoid, and a battery is provided. The boost circuit receives the battery DC power and then boosts the battery voltage to provide an output having a level sufficient for a fuel injection solenoid during the start process.

18 Claims, 1 Drawing Sheet

START-ASSIST CIRCUIT

This application is a Continuation of application Ser. No. 09/170,853 filed Oct. 13, 1998 now U.S. Pat. No. 5,975,058.

BACKGROUND OF THE INVENTION

1. Field of the Invention

The present invention relates in general to internal combustion engines having fuel injectors and more particularly to circuitry for increasing the fuel injection solenoid voltage above that of the battery voltage during the starting process of such an engine.

2. Description of the Related Art Including Information Disclosed Under 37 CFR 1.97 and 1.98

It is well known that starting an internal combustion engine can sometimes be difficult for engines that have fuel injectors which often run at fuel injector solenoid activation voltages greater than 13 to 14 volts as is typically provided by the battery. Since the amount of fuel provided to the engine may be determined by the voltage applied to the fuel injector solenoids, a fuel injector which may be required to deliver fuel demands necessitating up to a 40-volt input will be limited to the amount of fuel provided by a 13-to-14-volt input during the starting process. When the engine is running, a demand for fuel in excess of that provided by a 13-to-14-volt is not a problem since the engine alternator may provide an output of greater than 40 volts. However, during the starting process, the alternator, of course, does not generate sufficient output and the only power source generally available is the battery, which normally will have an output of 13 to 14 volts with minimal load and significantly less under the cranking load experienced during the starting process.

Therefore, it would be extremely advantageous to have a power source available during the startup of a fuel injected internal combustion engine which could provide a voltage output to the fuel injectors significantly higher than the battery voltage so that an effective charge of fuel could be provided to the cylinders of the internal combustion engine during the starting process.

SUMMARY OF THE INVENTION

The present invention provides an "assist" circuit for increasing the fuel injector voltage during starting of an engine having fuel injectors. The start-assist circuit includes a switch for providing an engine start signal and a voltage boost circuit for receiving a battery DC input that may be insufficient to provide the necessary fuel infection voltage during the engine start process and provides an increased output voltage. A control unit is included in the boost circuit and is connected to the start switch so that the boost circuit provides the increased voltage only when the start signal is received.

Therefore, it is an object of the present invention to provide apparatus and methods to make available to the fuel injectors of an internal combustion engine a voltage greater than the battery voltage during the starting process.

BRIEF DESCRIPTION OF THE DRAWINGS

These and other features of the present invention will be more fully disclosed when taken in conjunction with the following Detailed Description of the Preferred Embodiment(s) in which like numerals represent like elements and in which.

DETAILED DESCRIPTION OF THE PREFERRED EMBODIMENT(S)

Figure 1:
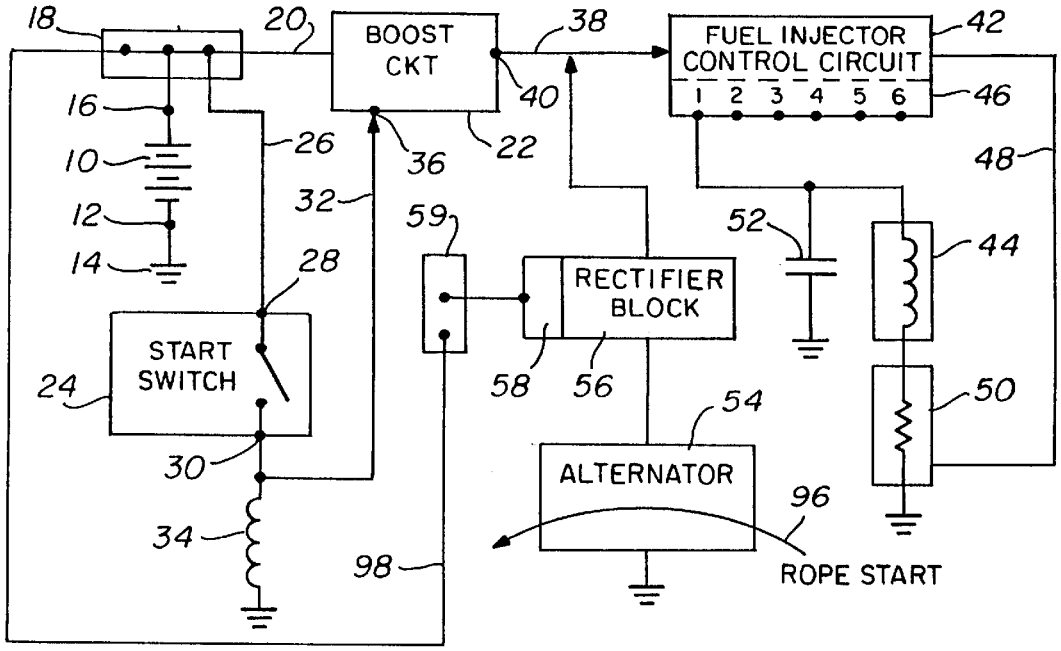
FIG. 1 is a block diagram showing a portion of an internal combustion engine electrical system for providing voltage to a fuel injector solenoid including a start-assist boost circuit according to the teachings of the present invention.

Referring now to the figures, there is shown a block circuit diagram of a portion of the electrical system of an internal combustion engine which powers and controls the fuel injection system. As shown, there is a battery 10 having its negative terminal 12 connected to a grounding system 14. The positive terminal 16 of battery 10 is connected to a power bus 18 which connects electrical power from the battery by line 20 to a boost circuit 22 which will be discussed hereafter. Other circuits related to the internal combustion engine which may require power prior to engine start may also receive power from power bus 18. As shown in FIG. 1, the start switch 24, which may for example be a key start switch or a push button or any other suitable starting switch mechanism, is connected to power bus 18 by connecting line 26 at the start switch input terminal 28. The output terminal 30 of start switch 24 is connected to line 32 which provides the battery power to starter solenoid 34 and the power input terminal 36 to boost circuit 22.

As shown, high-voltage output power is provided on connecting line 38 by the high-voltage output terminal 40 of boost circuit 22. Connecting line 38 provides the high-voltage output power to a fuel injection control circuit 42. The fuel injection control circuitry 42 controls the voltage provided or applied to the individual fuel injector solenoids of an internal combustion engine such as, for example, fuel injection solenoid 44 as shown in the drawing. It will be appreciated that there may well be a plurality of solenoids since there is typically a plurality of cylinders to an engine and sometimes, for some specialized engines, even more than one fuel injector per engine. Therefore, as shown, there is a distribution block 46 connected to fuel injector control circuitry 42 showing terminals for providing fuel injector current to up to six fuel injectors. Thus, the fuel injector control circuitry 42 not only controls the power to fuel injector 44 as shown in the drawing, but may also control the fuel injector power to other solenoids required by the internal combustion engine. It will be appreciated that a fuel injector solenoid may receive power having voltages over a very large range depending upon the speed setting of the engine. This voltage range of the power to the fuel injector solenoid may be very small for engine speeds just above a stall up to perhaps 40 volts when the engine throttle is at a maximum. It will also be appreciated that, for optimum performance, the output power applied to each individual solenoid may be somewhat varied depending upon the conditions of the particular cylinder, condition of the solenoids, and even the location of the cylinders in the engine block.

Consequently, there is also shown a feedback line 48 connected to a current sensor 50 for monitoring the current flow through the fuel injector solenoid. In the embodiment shown in FIG. 1, the current sensor is simply a wire connected at the top side of a resistor; however, other more complex and more accurate sensors could be used. The feedback line 48 provides a reading of the current flow back to the fuel injection control circuitry 42 such that continuous adjustments may be made for more accurate and efficient engine performance. There is also a capacitor 52 connected across solenoid 44 for tailoring the current profile through the solenoid coil.

It will farther be appreciated that in a typical internal combustion engine in addition to a battery source 10 there will also be a power generation source such as an alternator 54. The output of the alternator 54 is provided to a diode or rectifier block assembly 56 which converts the AC voltage of the alternator to a positive DC voltage. Typically, the output of the alternator may provide a continuous voltage of around 40 volts DC from the rectifier block 56 to the connecting line 38. Thus, when the engine is running, there may be a voltage of up to 40 volts available for use by the fuel injector control circuitry 42 in controlling the fuel injector solenoid current. Also as shown, the rectifier block 56 may also include voltage regulation circuitry 58 which will reduce the 40-volt DC output of the rectifying circuit to a selected value less than 40 volts. Typically a value of 12 volts is provided which is then connected to the accessory power bus 59 such that various accessories may also be powered. As is well known in the art, the most common accessory power requirements are 12 volts.

Thus the operation of the fuel injector power circuit when the internal combustion engine is running, is provided by the alternator 54. As will be discussed later, the boost circuit 20 will not be providing an output when the start switch 24 is not closed or activated. Thus in normal operations, there is a 40-volt power source on connecting line 38 to the fuel injector control circuitry 42 which, as was discussed heretofore, may vary the current to the fuel injector solenoid and, consequently, the speed of the engine as demanded by the throttle settings of the engine. With a power source having available up to 40 volts for application to the fuel injector solenoids, the range of fuel provided to the cylinder by the fuel injector may vary from just above a stall during idle up to a maximum full-throttle setting. However, if the engine is not running and must go through a cold start, it will be appreciated that typically only a 12-volt power supply such as battery 10 will be available. Further, for a cold engine, the cranking power requirement may well be so large that the battery output may be lowered during the cranking process to a value no greater than around 7 volts. Thus, without the boost circuit of the present invention, there would never be more than 12 volts available for the fuel injector solenoids during a start and, sometimes, as low as 7 volts. Further, since it is often desirable to start a cold engine with a rich fuel mixture (that is a higher percentage of gasoline to oxygen) the 7 or 12 volts available for the fuel injectors simply may not be sufficient and certainly not optimum for a cold start. Therefore, to assure quick, easy starts of a cold gasoline engine with fuel injectors, it would be extremely advantageous to have available a significantly higher voltage power source than the 7 or 12 volts which would be available from a battery providing cranking power.

Figure 2:
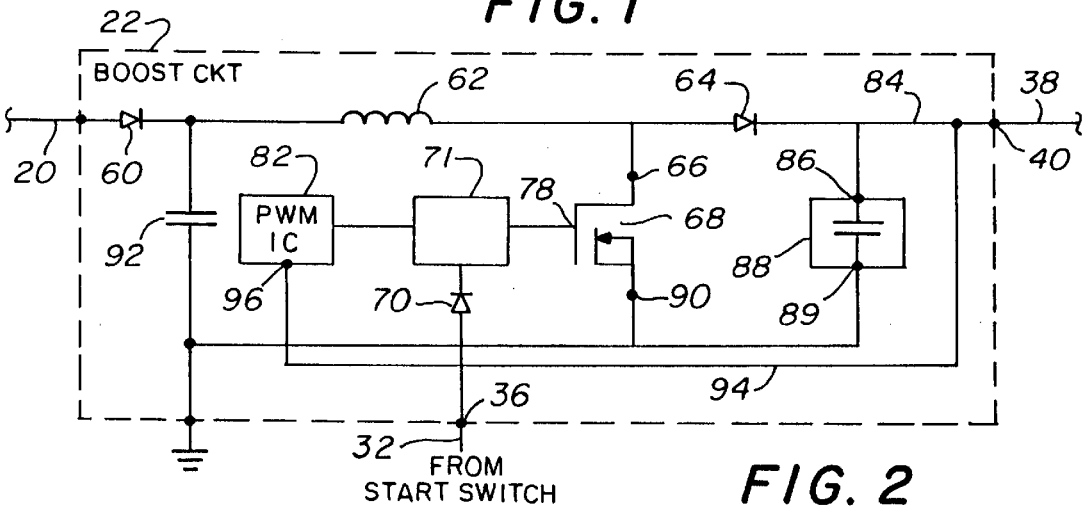
FIG. 2 is a circuit diagram of the start-assist boost circuit of FIG. 1.
Figure 3:
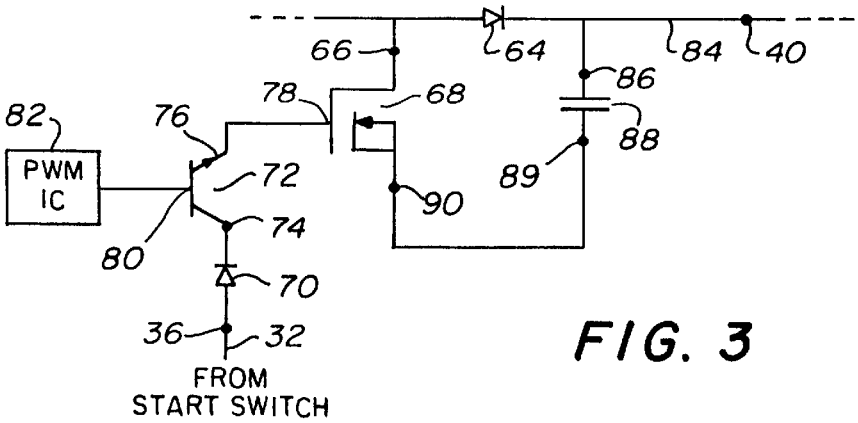
FIG. 3 shows further details of the boost circuit of FIG. 2.

Referring now to FIGS. 2 and 3, there is shown a particularly effective boost circuit 22 for providing a higher voltage output for the fuel injector solenoids during the starting process. As shown, the voltage input from battery 10 is provided on line 20 through blocking diode 60 to coil 62. Coil 62 is an inductor that is required in a fundamental boos circuit of this type. Energy is stored in coil 62 when MOSFET 68 is conducting. When MOSFET 68 turns OFF, the interruption of current through coil 68 generates a higher voltage than the input voltage (battery 10). This is proved in the basic equation for an inductor:

$$V_L = di/dt\ L$$

The output of coil 62 is then connected to a blocking diode 64 and to the drain terminal 66 of a MOSFET 68 (metal oxide silicon field effect transistor). The output or cathode of diode 64 is connected to terminal 40 of boost circuit 22 which, in turn, is connected to connecting line 38. The start signal from start switch 24 on line 32 is received at start input terminal 36 of booster circuit 22. The start signal is then provided from terminal 36 to a diode 70. Diode 70 is included in the circuitry to z z prevent damage to the boost circuit in the event a reverse battery connection is made by accident. The output of diode 70 is provided to a control circuit 71 such as for example bipolar PNP transistor 72 as shown in FIG. 3. The output of diode 70 is provided to the collector 74 of transistor 72. The emitter 76 of transistor 72 is, in turn, provided to the gate 78 of MOSFET 68. The gate 80 of transistor 72 is connected to a pulse-width modulator integrated circuit 82.

Line 84 connects the output or cathode of diode 64 to output terminal 40 and, in addition, is connected to the capacitor terminal 86 of power capacitor 88. The other capacitor terminal 89 of capacitor 88 is connected to the source terminal 90 of FET 68. Also connected between the source terminal 90 of FET 68 and between diode 60 and coil 62 is a filter capacitor 92. A feedback line for sensing output voltage of boost circuit 94 is connected to line 84 and to an input terminal 96 of pulse-width modulator integrated circuit 82 for purposes of maintaining the output voltage at a selective level, such as, for example, approximately 20 volts.

Operation of boost circuit 22 as described above begins when start switch 24 is closed and a battery voltage of 7-to-12 volts is provided to the boost circuit at terminal 36. As shown, when the start switch is closed, a battery voltage of between 7-to-12 volts will already be present at the capacitor terminal 86 of power capacitor 88. Power from the start switch, when closed, will be applied to transistor 72 such that, when the pulse-width modulator 82 provides a pulsing output, emitter 76 of transistor 72 will, in turn, turn MOSFET 68 ON and OF. Since the drain 66 of MOSFET 68 is connected to the source of battery power through coil 62, the switching ON and OFF of MOSFET 68 results in a voltage pumping action such that the voltage increases across power capacitor 88 and this higher voltage is provided at high-voltage output terminal 40 and thereby available to the fuel injector control circuitry 42 for controlling the power supplied to the fuel injection solenoid 44 during the starting process.

Also as shown in FIG. 1, the start-assist circuit of this invention may be used to assist engine starting when a rope pull (diagrammatically shown at 96) is used, for example, when battery 10 is dead. As shown, line 98 is connected from power bus 59 to bus 18. The alternator will generate an arbitrary amount of power during a rope pull. Consequently, the boost circuit can be used to boost the power from the alternator which may be limited at rope-start speeds. Although not shown, blocking diodes, switches, or other components may be used to assure proper circuit isolation and protection.

The corresponding structures, materials, acts, and equivalents of all means or step plus function elements in the claims below are intended to include any structure, material, or act for performing the function in combination with other claimed elements as specifically claimed.

What is claimed is:

1. A circuit for providing a voltage boost to at least one fuel injector of an engine comprising:

a first switch providing a signal during starting of the engine; and a boost circuit coupled to the first switch, the boost circuit receiving an available input voltage of a first potential and providing an output voltage of a second increased potential to the at least one fuel injector during starting of the engine based on the signal.

2. The circuit of claim 1, wherein the first switch is activated by the starting of the engine.

3. The circuit of claim 1, wherein the available input voltage is supplied by a battery.

4. The circuit of claim 1, wherein the available input voltage is supplied by an alternator.

5. The circuit of claim 1, wherein the increased potential is a predetermined voltage of up to 40 volts.

6. The circuit of claim 1, further comprising a fuel injector control circuit coupled to the boost circuit and to at least one fuel injector solenoid for supplying the output voltage to a fuel injector solenoid.

7. The circuit of claim 6, further comprising a current sensor electrically in series with the at least one fuel injector solenoid for generating a feedback signal applied to the fuel injector control circuit.

8. The circuit of claim 1, wherein the at least one injector is a plurality of injectors, and wherein the circuit further comprises a distribution block electrically coupled with the plurality of fuel injectors, the distribution block controlling the delivery of the output voltage to the plurality of fuel injectors according to a predetermined sequence.

9. A circuit for providing a voltage boost upon start-up of an internal combustion engine comprising:

a battery;

a switch connected to the battery, the switch providing a signal upon the start up of the engine;

a boost circuit coupled to the switch, the boost circuit receiving an input voltage from the battery and providing an increased output voltage during engine start-up based upon receipt of the signal; and an electrically actuated fuel injector coupled to the boost circuit, the fuel injector receiving the increased output voltage during engine start-up.

10. The circuit of claim 9, further comprising a fuel injector control circuit coupled to the boost circuit and to the fuel injector for applying the output voltage to the fuel injector.

11. The circuit of claim 10, wherein the fuel injector includes a solenoid coil, and wherein the circuit further includes a current sensor electrically in series with the solenoid coil for detecting current through the coil.

12. The circuit of claim 11, wherein the current sensor generates a feedback signal representative of the current through the coil and applies the feedback signal to the control circuit.

13. The circuit of claim 10, wherein the control circuit is coupled between the boost circuit and a plurality of injector coils for regulating application of the output voltage to the injector coils.

14. A method for boosting a voltage supplied to at least one fuel injector of an engine during starting the engine comprising:

providing a signal upon the initiation of starting the engine;

receiving an input voltage from an available source at a first potential into a boost circuit;

providing an output voltage of a second increased potential from the boost circuit to the fuel injector; and sustaining the output voltage during at least a portion of starting the engine.

15. The method of claim 14, wherein the available source comprises a battery.

16. The method of claim 14, wherein the available source composes an alternator.

17. The method of claim 14, wherein the step of providing an output voltage of a second increased potential comprises providing a predetermined voltage of up to 40 volts.

18. The method of claim 14, comprising the further steps of detecting current flowing to the fuel injector and regulating application of the output voltage to the injector based upon the detected current.

* * * * *